United States Patent [19]

Mahvi

[11] Patent Number: 4,815,732

[45] Date of Patent: Mar. 28, 1989

[54] EXERCISING CHAIR

[76] Inventor: Pascal Mahvi, 17 Mont Pellier, Newport Beach, Calif. 92660

[21] Appl. No.: 115,388

[22] Filed: Nov. 2, 1987

[51] Int. Cl.[4] ..... A63B 23/02

[52] U.S. Cl. ..... 272/144; 272/143; 272/903; 297/115; 297/367; 297/467

[58] Field of Search ..... 272/125, 144, 145, 126, 272/143, 903; 297/16, 19, 29, 34, 35, 39, 115, 117, 355, 361, 367, 369, 378, 381, 466, 467, 204, 27, 28, 37, 40, 49, 50, 359, 366, 370, 372; 128/24 R, 25 R, 33

[56] References Cited

U.S. PATENT DOCUMENTS

| | | | |
|---|---|---|---|
| 271,857 | 2/1883 | Johnson et al. | 297/19 |
| 333,052 | 12/1885 | Brooks | 297/367 X |
| 425,778 | 4/1890 | Goetel | 297/367 |
| 2,069,384 | 2/1937 | Ogden | 272/57 |
| 2,310,476 | 2/1943 | Todd | 297/367 X |
| 2,608,237 | 8/1952 | Lecroy | 155/28 |
| 2,924,456 | 2/1960 | Miller | 272/79 |
| 3,043,591 | 7/1962 | Sellner | 272/58 |
| 3,096,963 | 7/1963 | Welsh | 297/19 X |
| 3,216,738 | 11/1965 | Bockus | 297/467 X |
| 3,286,708 | 11/1966 | Gartner | 128/24 |
| 3,716,230 | 2/1973 | Mark | 272/58 |
| 3,992,057 | 11/1976 | Studebaker | 297/467 |
| 4,182,511 | 1/1980 | Camp, Jr. | 272/145 |
| 4,474,370 | 10/1984 | Oman | 272/144 |
| 4,509,746 | 4/1985 | Mask | 272/144 X |
| 4,531,731 | 7/1985 | Law | 272/145 |
| 4,627,610 | 12/1986 | Ishida et al. | 272/72 |
| 4,650,187 | 3/1987 | Chenera | 272/145 |
| 4,712,791 | 12/1987 | Edwards | 272/144 X |

FOREIGN PATENT DOCUMENTS

| | | | |
|---|---|---|---|
| 503909 | 6/1954 | Canada | 272/144 |
| 540837 | 2/1922 | France . | |
| 559533 | 9/1923 | France | 272/144 |
| 0110029 | 8/1979 | Japan | 272/144 |

*Primary Examiner*—Richard J. Apley
*Assistant Examiner*—David J. Bender
*Attorney, Agent, or Firm*—Stetina and Brunda

[57] ABSTRACT

A device for stretching of an anatomical portion of the human body, thereafter holding such body portion in a stretched position for a period of time and thereafter returning such body portion to its original, unstretched position is disclosed. A horizontal base platform is provided with a generally vertical support member. The generally vertical support member is freely movable in a first direction with respect to the base platform member but is restricted from movement in a second direction opposite the first direction. Thus, the user of the device may position the subject anatomical body part in contact with the generally vertical support member and thereafter move the support member in the first direction until such time as the subject body part is optimally or maximally stretched. Thereafter the support member will hold the subject body part in the stretched position until such time as the user releases a uni-directional mechanism which permits the support member to move in the second direction opposite the first direction, thereby permitting the subject body part to return to its original, unstretched position. The support member is restricted substantially between a generally vertical position and locked positions forming an acute angle with the horizontal base.

6 Claims, 2 Drawing Sheets

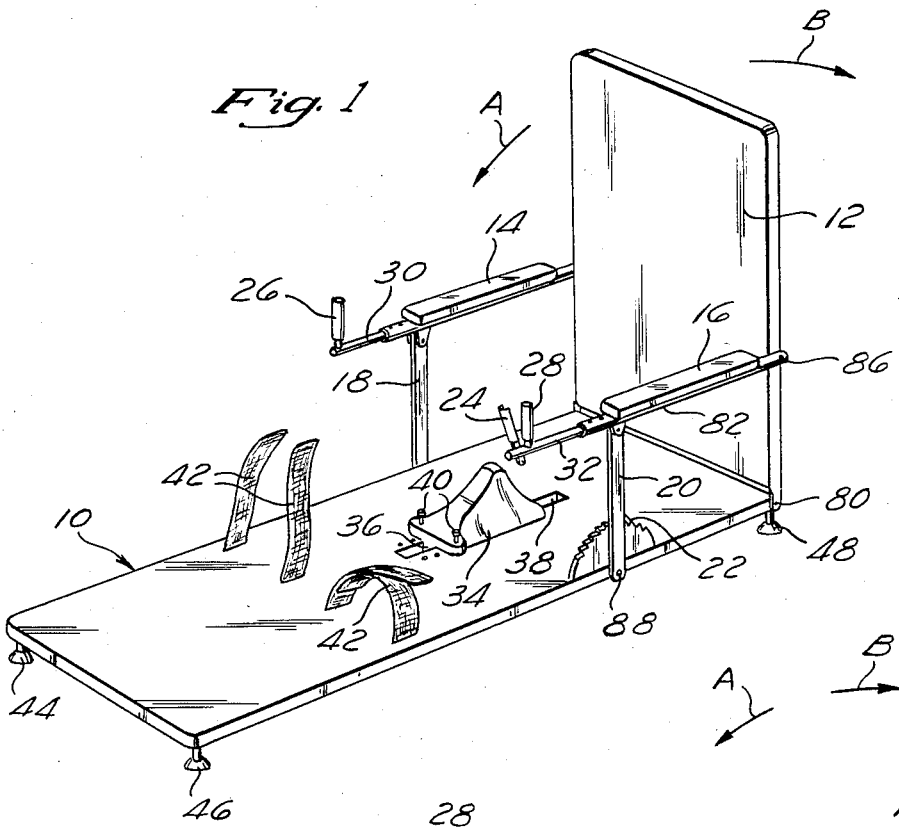
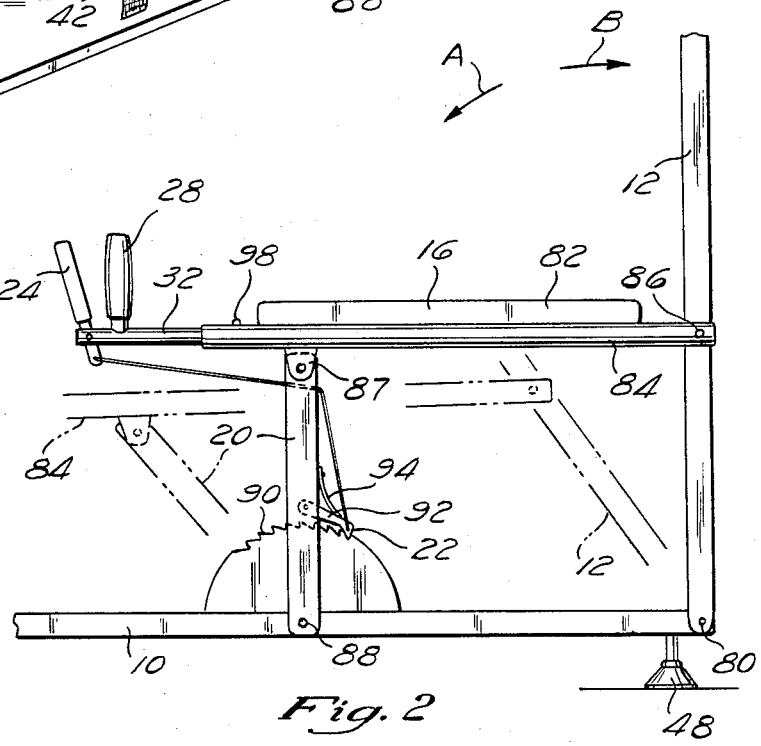
Fig. 2
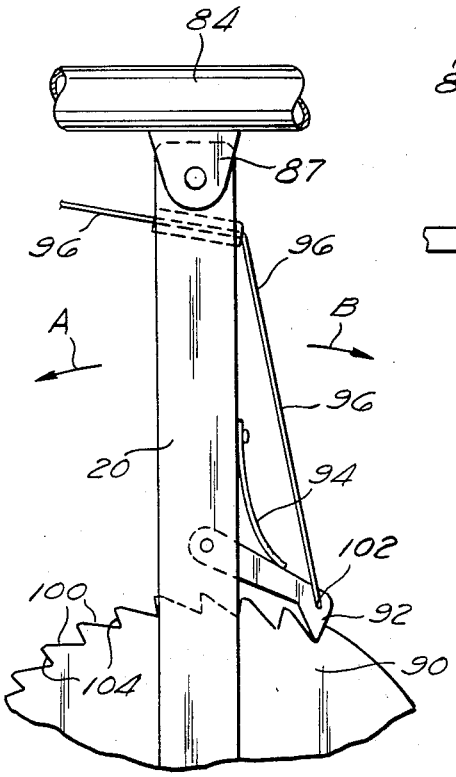
Fig. 3

Fig. 4
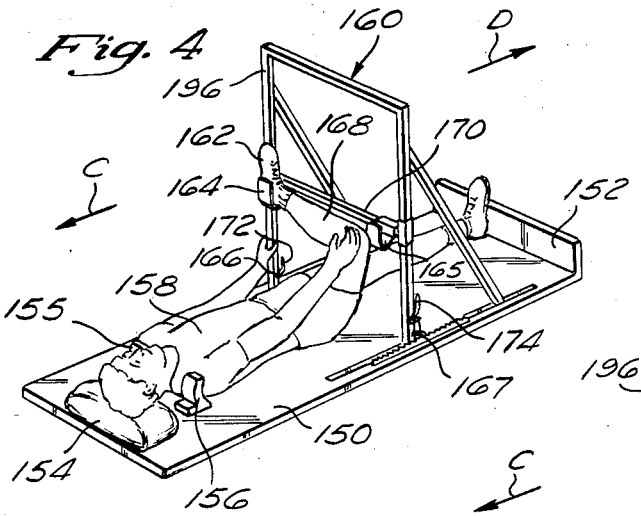
Fig. 5
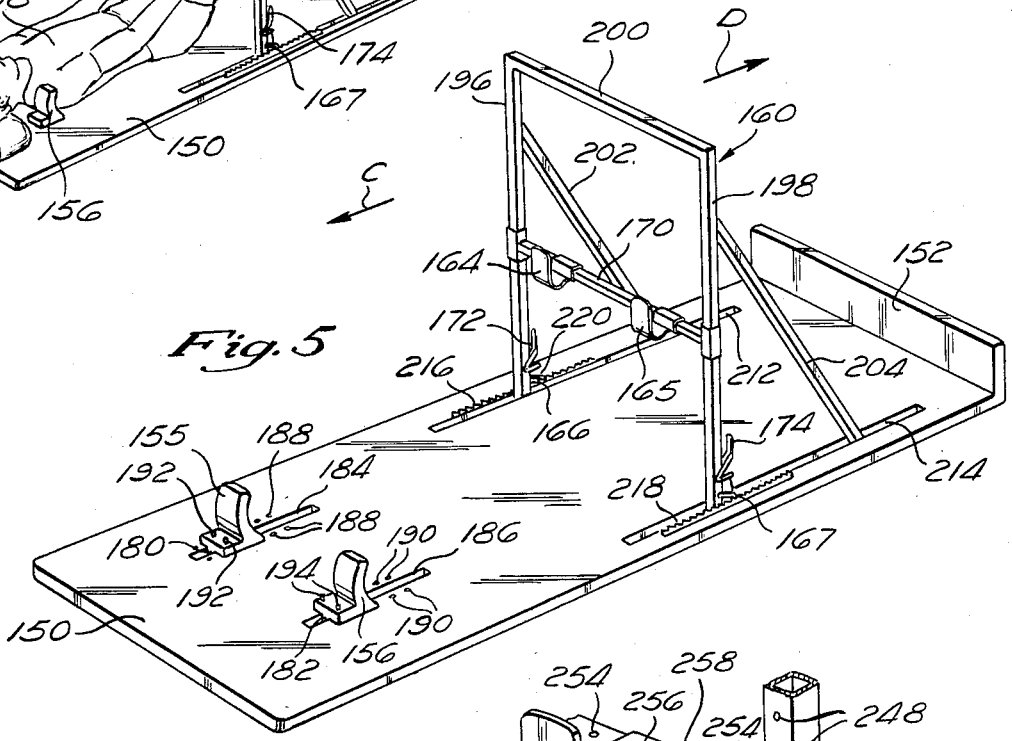
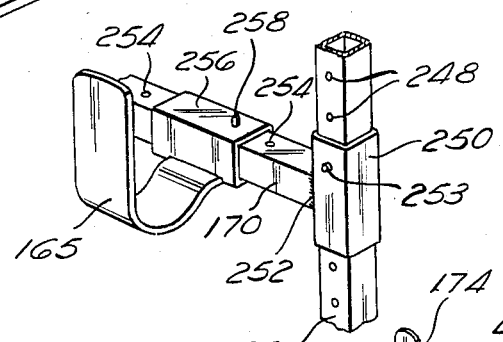
Fig. 6
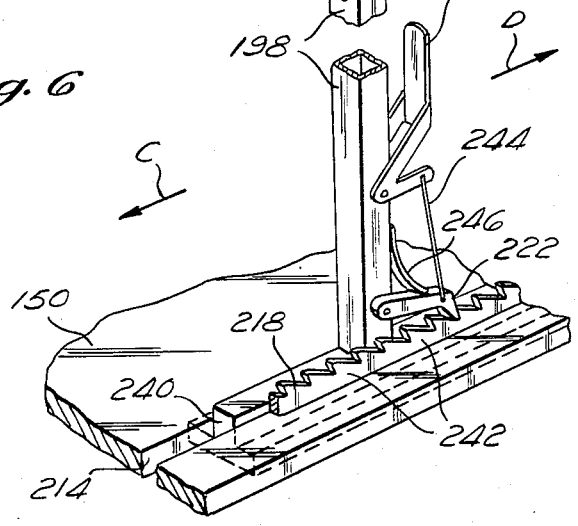

EXERCISING CHAIR

BACKGROUND OF THE INVENTION

The present invention relates generally to an improved exercise apparatus and, more particularly, to a device for stretching and/or strengthening muscles and ligaments by guiding a portion of the user's body to a stretched position and holding such stretched position until such time as the user wishes to return to the initial relaxed position.

In recent years the importance and relative benefits of various types of exercise have been more fully elucidated. It is now believed that slow, consistent stretching of muscles and ligaments prior to certain types of exercise may help to prevent injuries and strains during subsequent exercise. Additionally, programs of controlled stretching are frequently undertaken as therapeutic endeavors or as desirable means of rehabilitating and conditioning the body.

The prior art is replete with exercise devices for accomplishing various types of exercise, however, none of the devices are specifically designed for unidirectional stretching of specific anatomical portions of the body. Some of the prior art devices are designed for exercising isolated muscles groups, while others are intended for more sustained "cardiovascular" exercise involving many muscles of the body such as rowing or pedaling movements.

A number of the prior art exercise devices contemplate movement of the body in a bending fashion. For example, U.S. Pat. No. 3,043,591 discloses a seating and reclining device which is particularly intended for use an an exerciser. Such device generally comprises a body supporing frame member having a flexible joint located near its longitudinal midpoint such that a human subject may position himself upon the cot-like frame in a supine position and thereafter cause both ends of the frame to pivot upwardly forming a V-shape. Alternatively, the user may lay on the cot-like frame in a prone position and cause both ends of the device to be pivoted downwardly, forming an inverted V-shape. Such movements purportedly exercise the stomach, back and leg muscles.

Another example of the prior art is the exercising cot disclosed in U.S. Pat. No. 3,716,230. Such exercise cot is provided with a central pivot point such that the user may move the ends of the cot up and down in a reciprocal manner repeatedly forming a shallow V-shape and the inverse thereof. The exercise cot of U.S. Pat. No. 3,716,230 is claimed to be convertible to a fixed chair, a rigid slant board, and flexible body supporting exerciser for use on a floor.

Another exercise device of the prior art is that of U.S. Pat. No. 4,182,511 which discloses a substantially rectangular frame positioned on two pair of support legs, one such pair of legs being pivotally connected to the other pair, while the other pair is pivotally connected to the rectangular frame. The frame itself comprises a pair of telescoping U-shaped members incorporating a seat and a pair of foot rests such that the user may position his buttocks on the seat, his feet within the foot rests, and proceed to exercise his upper torso by extending it over the edge of the device.

U.S. Pat. No. 3,286,708 discloses a health rest with tiltable support. Such device generally comprises a tiltable board-like support member which is provided with adjustable foot and shoulder holding means. The foot and shoulder holding means are adjustable so as to enable the device to be used by persons of differing sizes. The board-like support may then be tilted about a horizontal axis, allowing the user to rest upon the board in a tilted, head down position, with the user's body being supported by the foot holders and resting on the shoulder supports.

Various other prior art exercise devices are disclosed in U.S. Pat. Nos. 540,837 (France); 2,069,384; 2,608,237; 2,924,456; 4,531,731; 4,474,370; 4,650,187; and 4,627,610.

The prior art as a whole provides various means for actively exercising specific muscle groups, obtaining sustained cardiovascular exercise or even simply resting in a tilted position. However, Applicant is aware of no prior art device which provides a convenient and usable means for passively stretching and exercising muscles of the upper and/or lower torso by permitting uni-directional movement of a specific anatomical portion of the body to a stretched position and thereafter holding the body part in such stretched position for a period of time desired by the user. In view of the known therapeutic and athletic benefits of slow, even stretching of muscles and ligaments, it is clear that a device capable of accomplishing such stretching is desirable. Because none of the prior art exercise devices are capable of such unidirectional stretching, there exists a need for such device and it is believed that the present invention fills such need.

SUMMARY OF THE INVENTION

The present invention contemplates a new and improved exercise device which overcomes the above-referred to deficiencies in the art by providing an effective means for stretching specific anatomical portions of the upper and/or lower body in a uni-directional manner and thereafter holding the subject body portion in a stretched position for a period of time determined by the user of the device.

In accordance with the present invention, there is provided an exercise apparatus having a generally horizontal base platform and at least one generally vertical support surface, against which a portion of the body may be positioned. The vertical member is generally uni-directionally movable. Such uni-directional movement capability is accomplished by a uni-directional ratchet mechanism which permits the vertical member to be slidably or pivotally advanced to a desired point whereat the subject body part is optimally or maximally stretched. Thereafter, the vertical member holds the subject body part in such stretched position until such time as the unidirectional ratchet mechanism is released, thereby permitting return of the subject body part to its initial, unstretched position.

In accordance with one preferred embodiment of the invention there is provided a passive exercise device comprising a horizontal base platform member, a back support member pivotally connected to and extending vertically upward from said base platform member, a pair of telescoping arm members and a uni-directional ratchet mechanism. Each of these elements are operatively interconnected such that the lower body of the user may be positioned on the lower platform member, the back of the user may be positioned against the movable back portion and the user's arms may be placed on the telescoping arm members. Subsequently, the movable back portion may be tilted forward in the direction permitted by the uni-directional ratchet mechanism to stretch various muscles of the abdomen, back and thighs of the user.

In accordance with another aspect of the present invention, a single exercise device for slow, consistent stretching of various anatomical portions of the body is designed to be convertible between at least two configurations, each such configuration being specifically adapted to accomplish the desired stretching of a particular anatomical portion of the body.

In accordance with a still further aspect of the present invention, the exercise devices of the foregoing character are provided with various body positioning and restraining means including but not limited to such items as belt-like straps for holding the limbs in position, a saddle horn device for positioning of the lower torso, padded arm rests for resting of the forearms, shoulder supports for positioning the shoulders, etc.

In accordance with an even further aspect of the invention, the aforestated positioning devices and the exercise devices on which they are mounted are provided with a degree of adjustability so as to permit use of a single exercise device by users of varying body size.

In accordance with a still further aspect of the present invention, the uni-directional ratchet mechanism which provides for uni-directional movement of the vertical support surface (i.e. the backsupport member) comprises a ratchet mechanism having cammed teeth with a spring loaded pawl engaging such cammed teeth such that the pawl will glide over the surfaces of said teeth in a first direction but will firmly engage the underside of such teeth, thereby preventing movement of the device in a direction opposite such first direction until such time as the pawl is retracted from frictional engagement with the ratchet teeth.

The principal object of the above-described invention is to provide a means whereby a specific portion of the human body may be slowly and evenly stretched to a given point, thereafter holding such body portion at that point for a desired period of time, and subsequently returning such body portion to its approximate original position.

Another object of the present invention is to provide a passive exercise device adapted for singular or repetitive stretching of the lower back, abdomen and thighs by positioning the subject individual in a sitting position, with the individuals back against a vertical support member and slowly advancing a back portion of the device in a forward manner, thereby permitting the individual to bend forward to some maximal point and to thereafter hold the subject individual in such position until such tim as the subject individual chooses to return to the approximate original, unstretched position.

A further object of the present invention is to provide exercise devices of the foregoing character which are safe, comfortable to use, sturdy and reasonably portable.

A still further object of the present invention is to provide exercise devices of the foregoing character which may be used by a single individual without the requisite assistance or collaborative effort of a second person.

An even further object of the present invention is to provide a single exercise device of the foregoing character which is modifiable and/or convertible to accomodate various body sizes and to accomplish stretching of various anatomical parts of the upper and lower body.

Additional objects and advantages of the present invention will become apparent to those skilled in the art upon reading of the following detailed description of the preferred species thereof and from the accompanying drawings.

DESCRIPTION OF THE DRAWINGS

FIG. 1 is a perspective view of an exercise device of the present invention designed to accomplish forward bending of the waist;

FIG. 2 is a side view of an exercise device of the present invention designed to accomplish forward bending of the waist;

FIG. 3 is a cutaway view of a portion of an exercise device of the present invention designed to accomplish forward bending of the waist;

FIG. 4 is a perspective view of an exercise device of the present invention designed to accomplish stretching of the lower extremities and having a human figure positioned thereon;

FIG. 5 is an enlarged perspective view of an exercise device of the present invention designed to accomplish stretching of the lower extremities;

FIG. 6 is a cutaway perspective view of a portion of an exercise device of the present invention designed to accomplish stretching of the lower extremities.

DETAILED DESCRIPTIONS OF THE PREFERRED EMBODIMENTS

Referring now to the drawings wherein showings are made for the purposes of describing preferred embodiments of the present invention and not for purposes of limiting same, FIG. 1 shows a passive exercise device for forward bending of the waist and stretching of the lower back, abdomen and thighs. The device shown in FIG. 1 includes a base platform member 10 and a generally vertical backrest 12, pivotally attached at its base to platform 10. Padded arm rests 14 and 16 are pivotally connected at their proximal ends to opposite sides of the vertically positioned backrest 12. The distal portions of armrests 14 and 16 are further pivotally connected to the top ends of support members 18 and 20, the bottom ends of which are in turn pivotally connected to base platform member 10.

A uni-directional ratchet mechanism 22 is mounted on base platform 10 and interacts with support member 20 to permit forward movement of support member 20 but to prevent backward pivotal movement of support member 20 until such time as release lever 24 is pulled by the operator thereby releasing uni-directional ratchet mechanism 22 and permitting such backward pivotal movement. The hand grips 26 and 28 are mounted on shafts 30 and 32 which are slidably adjustable within padded armrests 14 and 16 and may be advanced toward or away from the distal ends of armrests 14 and 16 to a point which is comfortable for the user. As the user sits on base platform member 10, saddle horn 34 functions to hold the subject's buttocks in proper position. Saddle horn 34 is provided with a longitudinal guide rail 36 which emanates downwardly therefrom. Guide rail 36 is lockingly, slidably retained within guide track 38, which appears in FIG. 1 as a longitudinal groove within the upper surface of base platform 10. Guide rail 36 and guide track 38 are generally T-shaped or dovetail structures such that guide rail 36 will remain locked, yet longitudinally slidable within guide track 38, thereby permitting adjustment of the saddle horn 34 within the guide track 38, but preventing undesired detachment of the saddle horn 34 from the base platform member 10. Set screws 40 are provided for the purpose of tightening saddle horn 34 in position and holding such preset adjustment. Leg straps 42 are also attached to base platform member 10 and provide a means of firmly holding the subject user's legs in position during exercise. Suction cups 44, 46 and 48 emanate downwardly from each of the four corners of the base platform member 10 and serve to prevent "walking" or undesired movement of the entire apparatus during use.

FIG. 2 provides an enlarged view of the unidirectional ratchet mechanism 22 which controls forward advancement, and also prevents undesired backward retraction, of the back support member. FIG. 2 shows base platform member 10 pivotally attached at one end 80 to vertically positioned back support member 12. Padded arm support 16 is seen to comprise an upper pad 82 and a lower tubular member 84. The proximal end of padded arm support 16 is pivotally attached midway up back support member 12 at pivot point 86. Several inches from the distal end of tubular member 84 there exists an attachment lug 86 emanating downwardly therefrom and providing a means for pivotal attachment of armrest 16 to the upper end of vertical support member 20. The lower end of the samd vertical support member 20 is attached to the outer edge of base platform member 10 at pivot point 88. An arcuate ratchet mechanism 90 is mounted on the upper surface of base platform adjacent to vertical support member 20. A pawl 92 is attached to vertical support member 20 and is downwardly loaded by spring 94 such that pawl 92 will frictionally engage the individual teeth of arcuate ratchet surface 90. The teeth of ratchet 90 are cammed in a forward direction (direction A) such that pawl 92 will slidably advance over the tooth surfaces in the direction of arrow A thus permitting unrestricted forward pivotal movement of the exercise device. However, the forward camming of the ratchet teeth 90 also prevents reverse movement of the spring biased pawl 92 over the teeth of ratchet 90 in direction C. Thus, the mechansim firmly restricts the pivotal movement of the device to a forward direction until such time as pawl 92 is retracted against spring 94.

The retraction of pawl 92 against spring 94 is accomplished by pulling lever 24, thereby retracting cable 96 and resulting in upward retraction of pawl 92 against spring 94. This permits pivotal movement of the back support member 12 and vertical support member 20 in the direction denoted by arrow B, thereby enabling the user to return the exercise device to its full upright position at the end of desired stretching period. Lever 24 is positioned in close proximity to hand grip 28 to enable the user to easily move lever 24 without removing the hand from hand grip 28. The position of hand grip 28 and lever 24 relative to armrest 16 is, of course, adjustable by sliding shaft 32 into or out of tubular member 84. Set screw 98 is provided for locking shaft 32 at its desired point within tubular member 84 and to subsequently prevent undesired sliding of shaft 32 within tubular member 84 during operation of the device. It is by the mechanism shown in FIG. 2 that the exercise device of the present invention may be utilized for forward bending of the waist with resultant stretching of the lower back, thighs and abdomen.

Specificially, the user's buttocks will be positioned on base platform member 10 such that the user's back will firmly engage vertically positioned back support member 12. The user's forearms will rest on arm rests 14, 16 and his hand will engage hand grips 26, 28. The user may then slowly bend in a forward direction pressing against hand grip 26 and 28 and pivotally advancing the back support member 12 and armrests 14, 16 in a forward direction as shown by phantom lines FIG. 2. Spring loaded pawl 92 will then prevent retraction of the device by directly engaging the undersides of the cammed teeth of arcuate ratchet surface 90. Such arrangement forces the user to hold the stretched position until such time as relaxation of the position is desired. When relaxation is desired, the user may then pull lever 24, thereby retracting cable 96 which pulls pwal 92 against spring 94. Retraction of the pawl 92 permits backward pivoting of vertical support member 20 and backrest 12 and returns the entire exercise device to its original upright position.

The specific design of the uni-directional ratchet mechanism may be appreciated in detail from FIG. 3 wherein there appears a cutaway view including the lower tubular member 84 of the padded armrest 16 of the device. Lug 86 emanates downwardly from tubular member 84. Lug 86 is pivotally attached to the top end of vertical support member 20. Arcuate ratchet surface 90 is mounted at the base of vertical support member 20 and is provided with a series of individual cammed teeth 100. Pawl 92 is pivotally attached to the inside surface of vertical support member 20 and is downwardly biased by spring member 94. The head of pawl 92 is provided with an aperture 102 passing therethrough. Cable 96 is connected to pawl 92 through aperture 102. Thus pawl 92, in its unretracted downwardly biased position, is capable of forwardly advancing over ratchet teeth 100 in a direction denoted by arrow A. However, when reverse movement in the direction of arrow B is attempted, downwardly loaded pawl 92 will frictionally engage the undersides of teeth 100 thereby preventing such reverse movement. It is only upon retraction of cable 96 that pawl 92 will be upwardly retracted against spring 94, thereby removing pawl 92 from frictional engagement with the undersides 104 of teeth 100 and permitting return of the exercise device in the direction denoted by arrow B.

An additional preferred embodiment of the present invention is shown in FIGS. 4 through 6. As shown in FIG. 4, this alternative embodiment comprises a base platform 150 having a vertical foot rest 152 at one end and a head cushion 154 at the other end. Shoulder rests 156 are also positioned on the upper surface of base platform 150. The user 158 lies in a generally supine position on base platform member 150 such that his feet will touch footrest 152 and his shoulders abut shoulder rests 156. A vertical frame 160 is slidably mounted on base platform member 150 and is controlled by unidirectional ratchet mechanisms 166 and 167. The user's foot 162 is positioned within a foot stirrup 164 which is positioned on a horizontal cross-member 170 of vertical frame 160. The vertical frame 160 is then drawn toward the upper torso of the user in the direction denoted by arrow C, thereby stretching the muscles and ligaments of leg 168. Upon reading a point where no further stretching is desired, the user may cease pulling vertical frame 160. The vertical frame 160 will then remain in such position due to the locking of uni-directional ratchet mechanisms 166 and 167. When it is desired to return the leg 168 to its unstretched position the user may pull levers 172 and 174, thereby releasing the unidirectional ratchet mechanisms 166 and 167 permitting vertical frame member 160 to be pushed in the reverse direction denoted by arrow D.

Specific aspects of the exercise device of FIG. 4 may be more fully appreciated from the enlarged perspective view of FIG. 5 wherein there is shown the base platform member 150 having a vertical footrest 152 emanating upwardly from one end thereof. Shoulder supports 155 and 156 are mounted on the upper surface of base platform member 150. Shoulder supports 155 and 156 are provided with linear guide rails 180 and 182 emanating downwardly therefrom. Guide rails 180 and 182 are positioned within corresponding guide tracks 184 and 186 which are parallel linear grooves on the upper surface of base platform member 150. Evenly spaced positioning indentations 188 and 190 are provided on either side of guide track 184 and 186. Set screws 192 and 194 of shoulder restraints 155 and 156 may be tightened into positioning indentations 188 and 190, thereby locking shoulder retraints 155 and 156 in a preadjusted position.

The vertical frame 160 comprises two vertical upright members 196 and 198 connected by a horizontal top bar 200 and having angular support members 202 and 204. Horizontal cross-member 170 is vertically slidable on uprights 196 and 198 and traverses therebetween. Foot stirrups 164 and 165 are mounted on cross-member 170 and are slidably adjustable therealong. Vertical upright members 198 and 196, as well as angular support members 202 and 204, are positioned at their bases within parallel linear guide tracks 212 and 214. By such arrangement the vertical frame member 160 remains slidable within linear guide tracks 212 and 214. Ratchet racks 216 and 218 are positioned parallel to and adjacent to linear guide tracks 212 and 214. Pawls 220 and 222 are attached to the bottom portions of vertical uprights 196 and 198 and are downwardly biased so as to frictionally engage ratchet racks 216 and 218 respectively. Camming of the individual teeth of ratchet racks 216 and 218 permits uni-directional movement of the vertical frame member 160 in direction C as the pawls 216, 218 will advance directly over the cammed teeth of racks 216 and 218. When, however, pressure is applied against vertical frame 160 in direction D, the pawls 220, 222 will directly engage the opposite surfaces of the teeth, thereby preventing movement of vertical frame 160 in direction D. Release levers 172 and 174 are connected to pawls 220 and 222 and provide a means whereby the downwardly biased pawls 220 and 222 may be disengaged from ratchet racks 216 and 218 thereby permitting movement of vertical frame 160 in direction D.

The precise manner in which the elements of the uni-directional ratchet mechanism interact may be appreciated from the cutaway view of FIG. 6 showing a portion of base platform member 150 including a segment of linear guide track 214. T-shaped guide rail 240 is slidably disposed within linear guide track 214. Vertical upright 198 is firmly attached to T-shaped guide rail 240, thereby permitting slidable movement of the vertical upright 198 and the attendant cross-bars which form the vertical frame. Pawl 222 is downwardly biased by spring 245 and frictionally engages ratchet rack 218 such that that head of pawl 222 will glide over the cammed surfaces of the individual teeth 242 of ratchet rack 218 in the direction denoted by arrow C. However, when pushed in the direction denoted by arrow D the head of pawl 222, being downwardly biased by spring 246, will directly engage the opposing angular surfaces of the cammed teeth 242, thereby preventing movement of the vertical upright 198 in the direction of arrow D. When it is desired to permit movement of the vertical frame in direction D, the release lever 174 may be depressed, thereby retracting pawl 22 via wire linkage 244. When pawl 222 is no longer in contact with the teeth 242 of ratchet rack 218 the vertical upright 198 and indeed the entire vertical frame (160) will be freely slidable in direction D.

FIG. 6 also shows a cutaway view of the adjustable horizontal leg support bar which is attached to vertical frame of the exercise device. As shown in FIG. 6, vertical upright 198 is made of hollow, square, metal stock and is provided, at its mid-portion, with a linear array of positioning apertures 248. A first square tubular sleeve 250 is positioned around vertical upright 198 and is firmly attached to one end of horizontal cross-member 170 by welds 252. Square sleeve 250 is provided with a corresponding single aperture through which a locking pin or bolt 253 is passed into one of positioning apertu 248, thereby locking cross-member 206 in position with respect to vertical upright 198. Horizontal cross-member 170 is also provided with an array of positioning apertures 254 within its upper surface and a second square sleeve 256 is slidably positioned around cross-member 170 and is provided with a single aperture through which a positioning pin or set screw 258 is passed. Foot support stirrup 165 is firmly attached to the second, square tubular sleeve 256. This second, square tubular sleeve 256 may be laterally manipulated along horizontal cross-member 170 to the desired position wherein positioning pin 258 may be placed through a positioning aperture 254 of cross-member 170, thereby locking stirrup 165 in its desired position.

The embodiment shown in FIGS. 4 through 6 is primarily intended to stretch the lower extremeties. The user may position his upper torso on the base platform 150 with one leg 168 on the user being raised so as to cross over the other leg. The raised leg 168 is positioned within one of the preadjusted and prepositioned foot stirrups 164, 165 of vertical frame 160. The user then pulls vertical frame 160 along linear guide tracks 212, 214 toward the user's upper torso (direction C) until reaching a desired point at which leg 168 is felt to be optimally stretched. The uni-directional ratchet mechanisms 166, 167 then prevent the vertical frame from returning to its original position, thereby holding the leg 168 in its stretched position. When the user wishes to return the leg to its unstretched position the user may depress release levers 172 and 174, releasing uni-directional ratchet mechanisms 166 and 167. The user may then push vertical frame 160 in a downward direction (direction D) thereby returning leg 168 to an unstretched position. This procedure is then repeated for the opposite leg.

The invention has been described with reference to the preferred embodiments thereof. Obviously modificiations and alterations will occur to those who read and understand this specification. It is my intention to include all such modifications and alterations as they come within the scope of the appended claims or the equivalents thereof.

What is claimed is:

1. An exercise device for stretching an anatomical portion of the human body, said device comprising:

a generally horizontal base platform sized to support the legs of a user thereon in a generally contiguous orientation;

a back rest pivotally attached to said base platform for pivotal movement substantially restricted between a generally vertical orientation relative said base platform to pivotal orientations forming an acute angle to said base platform;

a uni-directional ratchet mechanism cooperating with said base platform and said backrest for permiting pivotal movement of said backrest in a first direction toward said base platform while prohibiting pivotal movement of said backrest in a second direction opposite said first direction;

a pair of armrests pivotally attached to said backrest and extending outwardly therefrom in a plane generally parallel to said base platform;

a handgrip mounted to each of said pair of armrests adapted to be grasped in the hands of a user; and actuation means positioned adjacent at least one. of said handgrips to selectively disengage said uni-directional ratchet mechanism, said uni-directional ratchet mechanism enabling the user to pivotally move said backrest in said first direction to stretch an anatomical portion of the user's body to a desired position, and thereafter, hold said body portion in such stretched position until such time as said uni-directional ratchet mechanism is disengaged by manipulation of the actuation means, thereby permitting the user to return said backrest to its generally vertical orientation thereby relaxing said body portion.

2. The device of claim 1 including means for adjusting the position of said handgrips relative to said armrests so as to accomodate users of varying body size.

3. The device of claim 2 further comprising an elongate support member extending between each of said pair of armrests and said base platform.

4. The device of claim 3 wherein said uni-directional ratchet mechanism is mounted on said base platform member adjacent to at least one of said support members, said uni-directional ratchet mechanism comprising an arcuate ratchet surface having a series of ratchet teeth and a pawl pivotally attached to said at least one support member, said pawl being downwardly biased so as to frictionally engage the ratchet teeth.

5. The device of claim 4 wherein the teeth of said arcuate ratchet surface are cammed in a first forward direction so as to permit said pawl to frictionally glide over the surfaces of said teeth, thereby permitting said support member to bend forward in said first direction, said pawl being further adapted to directly frictionally engage the opposite sides of said cammed teeth, thereby preventing reverse movement of the device until such time as said pawl is removed from contact with said teeth.

6. The device of claim 5 wherein said pawl is operatively connected to said actuation means such that manipulation of said actuation means results in retraction of said pawl from frictional contact with said ratchet teeth, thereby permitting movement of said device in said second direction opposite said first direction.

* * * * *